US006474806B2

(12) United States Patent
Terauchi et al.

(10) Patent No.: US 6,474,806 B2
(45) Date of Patent: Nov. 5, 2002

(54) PRINTING MACHINE HAVING PRINT HEADS AND CONTROL METHOD THEREOF

(75) Inventors: Junichi Terauchi, Amimachi (JP); Takahiko Nakamura, Amimachi (JP); Hiroshi Kaneda, Amimachi (JP); Shoichi Miyata, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/963,454

(22) Filed: Sep. 27, 2001

(65) Prior Publication Data

US 2002/0039131 A1 Apr. 4, 2002

(30) Foreign Application Priority Data

Sep. 29, 2000 (JP) ..... 2000-301522

(51) Int. Cl.[7] ..... B41J 2/01; B41J 29/38
(52) U.S. Cl. ..... 347/104; 347/2; 347/16
(58) Field of Search ..... 347/2, 3, 5, 19, 347/16, 104, 49, 54; 399/405, 2

(56) References Cited

U.S. PATENT DOCUMENTS 5,595,381 A * 1/1997 Schickedanz ..... 271/12
6,226,471 B1 * 5/2001 Tsuzuki ..... 399/75

FOREIGN PATENT DOCUMENTS

JP 401176783 A * 7/1989 ..... B41J/13/00
JP 11-348385 12/1999 ..... B41J/29/38
JP 110348385 A * 12/1999 ..... B41J/29/38

* cited by examiner

*Primary Examiner*—Hai Pham
*Assistant Examiner*—An H. Do
(74) *Attorney, Agent, or Firm*—Gary M. Nath; Harold L. Novick; Marvin C. Berkowitz

(57) ABSTRACT

A printing machine includes a plurality of printing sections installed in a frame. Each printing section has a print head to print patterns on a print paper and a mechanism to feed print paper. The printing machine includes a print data input section configured to receive an input signal corresponding to a many-sheet print data of the patterns to be printed on the print paper; a print data allocation section configured to allocate the many-sheet print data to each printing section in units of pages; a fed paper delivery section configured to deliver print paper to each of the plurality of printing sections; and an ejected paper delivery section configured to deliver paper ejected from each of the plurality of printing sections in a desired sequence to a common output location.

17 Claims, 19 Drawing Sheets

(PAGE 12, 10 COPIES, 5 PRINTERS)

PRINTING MACHINE HAVING PRINT HEADS AND CONTROL METHOD THEREOF

This application claims benefit of priority under 35 USC § 119 to Japanese Patent Application No. P2000-301522, filed on, Sep. 29, 2000, the entire contents of which are incorporated herein by reference.

BACKGROUND OF THE INVENTION

1. Field of the Invention

The present invention relates to a printing machine having print heads and a control method of the printing machine.

2. Description of the Related Art

In the case of making a large amount of printed sheets, a cluster printer using a plurality of printers has been proposed. More specifically, the cluster printer allocates the many-sheet print data to the plurality of printers connected via a network from one personal computer, and concurrently operates these plural printers, and thereby, shortens a time to make printed sheets.

A printer which realize high-speed printing by allocating a print data to a plurality of printing sections arranged in parallel, and concurrently operating these printing sections, has been disclosed in Japanese Patent Application Laid-Open No. 11-348385 and the like, for example. In the high-speed printer, the plurality of printing sections are concurrently operated, and thereby, it is possible to perform printing at a higher speed as compared with a printing machine, which uses only one printer having the same performance as above.

The above-mentioned printer has the following problems. In other words, in the case of calculating a printing time for each page, and allocating a print data for each page to each printer so that a printing efficiency can be improved (the total printing time can be shortened), each printer has a paper delivery section; for this reason, the printed sheets must be collected in the paper delivery section. Further, a page sequence of the printed sheets is dispersed. For this reason, the printed sheets must be manually collated. In order to prevent the page sequence from being dispersed, the print data has not allocate; however, in this case, when a page having a large amount of data is collected to one printer, a print speed becomes slow.

In an integral-type printing machine including a plurality of printing sections, timing control for print start and print completion is required when feeding and discharging a print paper to each printer.

In the integral-type printing machine including a plurality of printing sections, in the case where there is difference in a paper feed and eject timing when printing to the print paper is completed in each printer, times takes to control paper delivery.

As a method for allocating a print data for each page to each printing section, an optimal method is variable depending upon the number of pages of print original, the number of copies, and a print time spent for each page; for this reason, it is difficult to select an optimal allocating method by a user.

SUMMARY OF THE INVENTION

The present invention has been made in view of the above problem in the related art.

An object of the present invention is to provide a printing machine, which includes a plurality of printing sections and a paper delivery section collected to one, and can perform high-speed printing without doing collate work by a user, and a control method thereof.

In order to achieve the above object, the aspect of the present invention inheres in a printing machine including a plurality of printing sections installed in a frame, each printing section having at least a print head, printing patterns on a print paper and a mechanism configured to feed the print paper. Especially, the printing machine encompasses a print data input means configured to input many-sheet print data of the patterns scheduled to be printed on the print paper; a print data allocating means configured to allocate the many-sheet print data to each printing section at a unit of page; a fed paper delivery means configured to feed the print paper to each of the plurality of printing sections; and an ejected paper delivery means configured to feed the print paper ejected from each of the plurality of printing sections. In addition, a pattern contains a character here.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the present invention in practice.

DETAILED DESCRIPTION OF THE PREFERRED EMBODIMENTS

Figure 1:
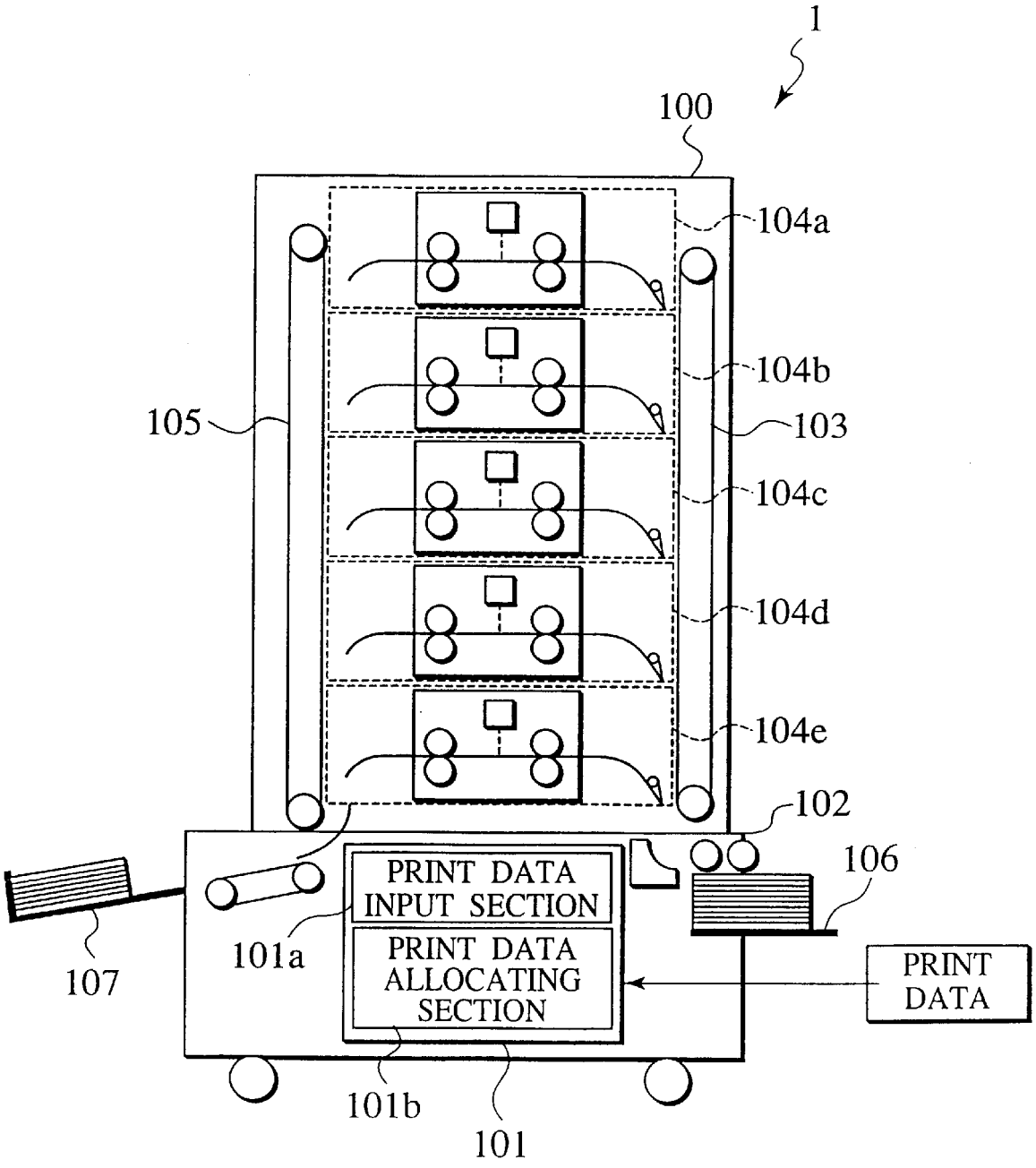
FIG. 1 is a view to explain a schematic configuration of a multi-layer printing machine according to a first embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

First Embodiment

As shown in FIG. 1, a multi-layer printing machine 1 includes: a frame 100; a control section 101 installed in the frame 100; a paper feed tray 106 for receiving a print paper; a paper feed section 102 for receiving the print paper in the paper feed tray 106 to feed the print paper successively; a plurality of printing sections 104*a*, 104*b*, 104*c*, 104*d*, 104*e*, each of which is fixed to the frame 100 of the printing machine and prints patterns on the print paper; a fed paper delivery section 103 delivering the print paper to the plurality of printing sections 104*a*, 104*b*, 104*c*, 104*d*, 104*e*; an ejected paper delivery section 105 delivering the print paper fed from the printing sections 104*a*, 104*b*, 104*c*, 104*d*, 104*e* to a paper receiving tray 107; and a paper receiving tray 107 receiving the print paper fed from the ejected paper delivery section 105.

In this case, the fed paper delivery section 103 and the ejected paper delivery section 105 may be provided with a mechanism, which attracts a print paper onto a conveyer belt by suction, in the case where the printing sections 104*a*, 104*b*, 104*c*, 104*d*, 104*e* are vertically arranged like this embodiment.

The control section 101 is composed of a print data input section 101*a* for inputting a print data image-formed on a print paper, and a print data allocating section 101*b* dividing the print data into a unit of page, and allocating a print data outputted to each printing section 104*a*, 104*b*, 104*c*, 104*d*, or 104*e* to a unit of page of the print data.

Figure 2:
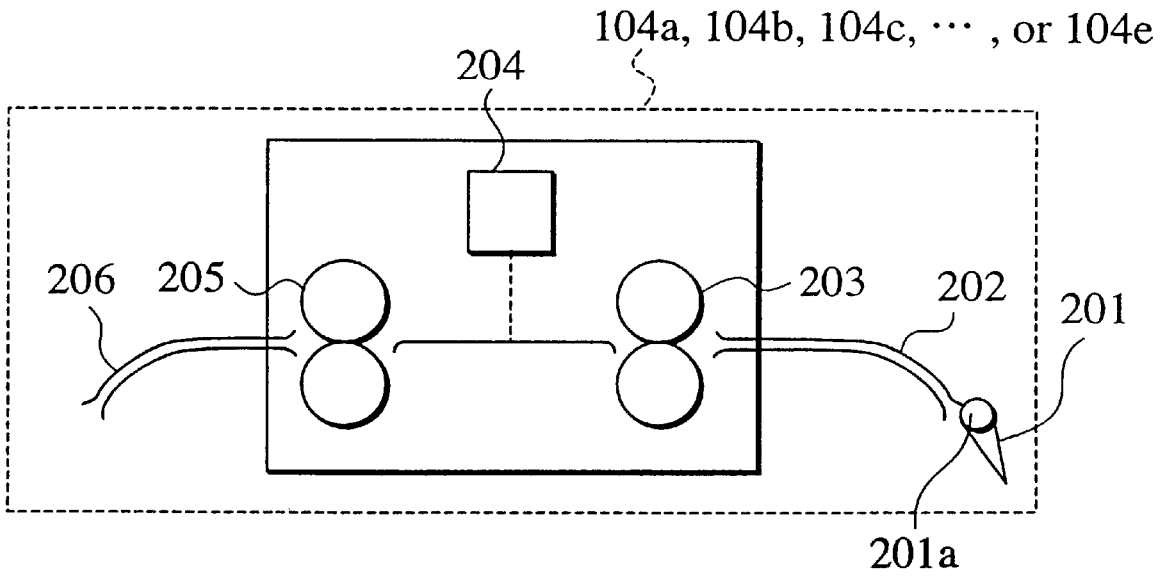
FIG. 2 is a view to explain a configuration of a printing section of the multi-layer printing machine according to the first embodiment of the present invention.
Figure 3:
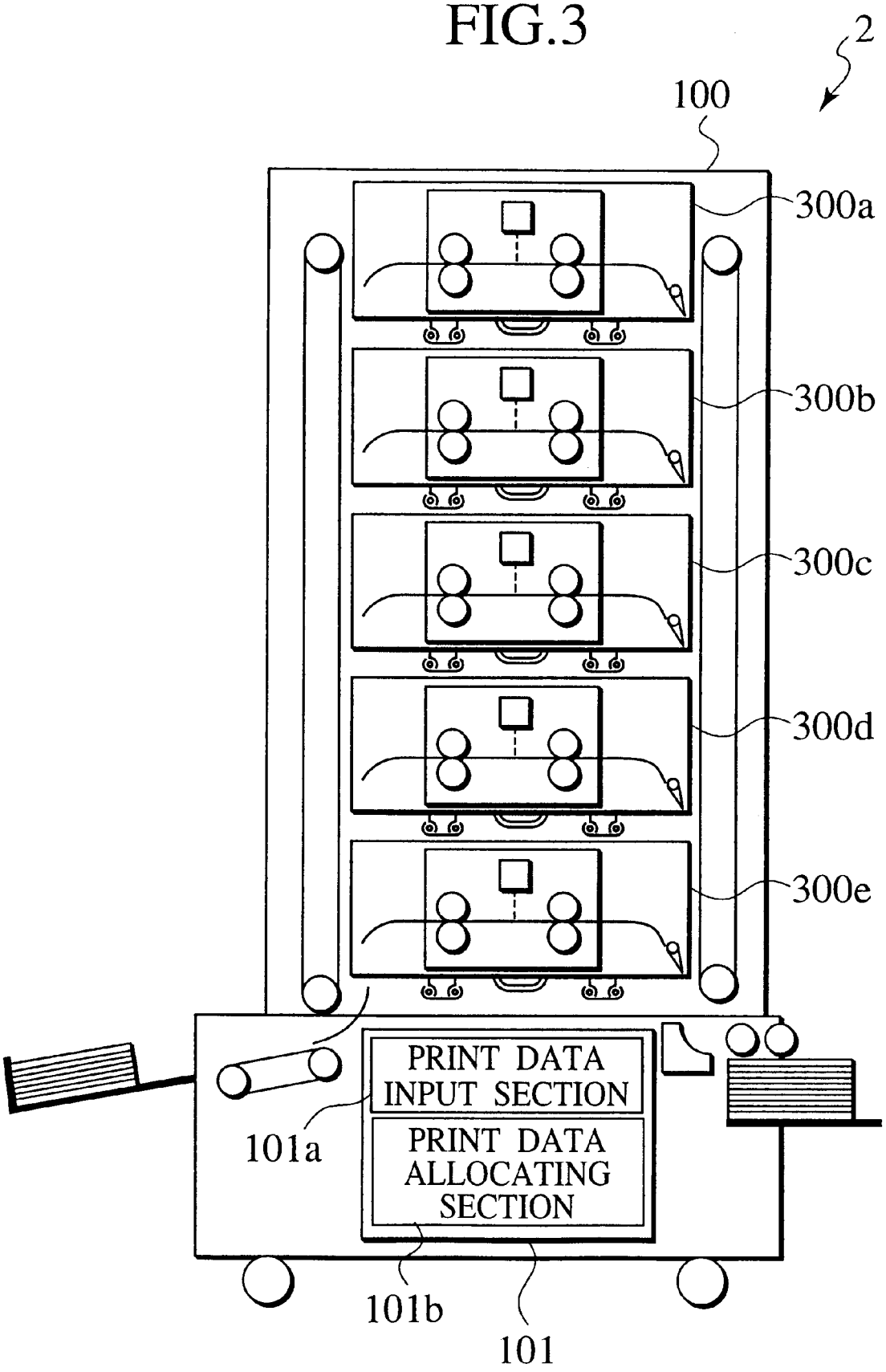
FIG. 3 is a view to explain a schematic configuration when the printing unit is used in the multi-layer printing machine according to the first embodiment of the present invention.
Figure 4:
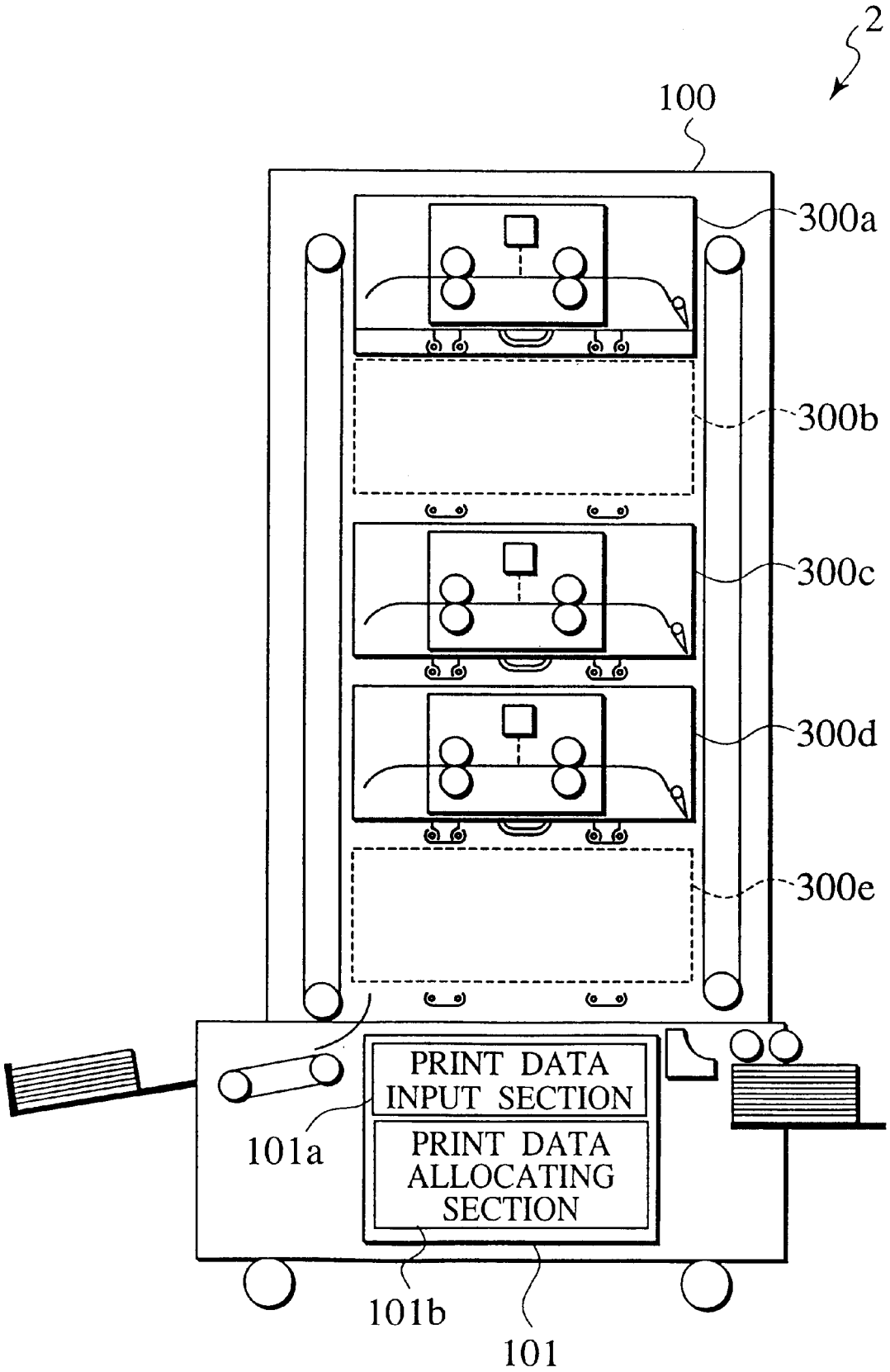
FIG. 4 is a view to explain a schematic configuration when the printing unit of the multi-layer printing machine shown in FIG. 3 is removed.
Figure 5:
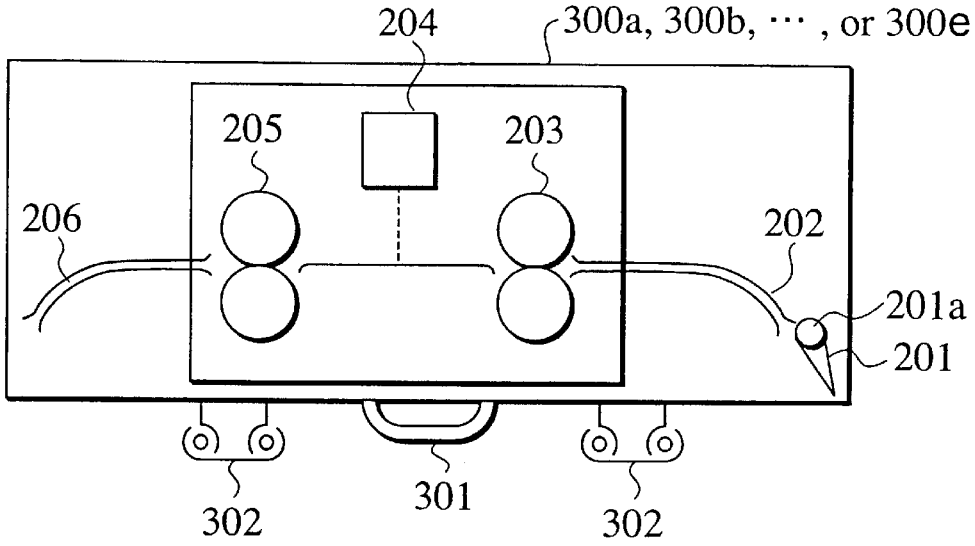
FIG. 5 is a view to explain a configuration of the printing section of the multi-layer printing machine shown in FIG. 3 and FIG. 4.

In the first embodiment, as shown in FIG. 2, first printing section 104*a* is composed of: a paper separating claw 201 for being rotatable around a rotary shaft 201*a* and taking the print paper fed from the fed paper delivery section 103 into the first printing section 104*a*; a first paper feed guide plate 202 for serving as a first auxiliary mechanism configured to deliver the print paper to a paper feed roller 203; a paper feed roller 203 feeding the print paper according to a print speed; a print head 204 printing the print paper; an eject roller 205 feeding the print paper to the ejected paper delivery section 105; and a second paper feed guide plate 206 serving as a second auxiliary mechanism configured to deliver the print paper to the ejected paper delivery section 105. Further, the first printing section 104*a* has a function of performing print to one print sheet. Moreover, the first printing section 104*a* is in a state of being fixed in the frame 100 of the multi-layer printing machine 1. The same explanations are hold for second to fifth printing sections 104*b*–104*e*, and overlapped explanations are omitted here. However, the printing sections 104*a*, 104*b*, 104*c*, 104*d*, 104*e* fixed to the frame 100 of the multi-layer printing machine 1 may be replaced by removable printing units 300*a*, 300*b*, 300*c*, 300*d*, 300*e*, respectively as shown in FIG. 3. As shown in FIG. 4, the printing unit 300*b* or 300*e* may be removed from the frame 100, or the main body of the multi-layer printing machine 2 one by one like a drawer. In this case, each of the printing unit 300*a*, 300*b*, 300*c*, 300*d*, and 300*e* may be provided with a printing section draw-out handle 301, and a printing section draw-out auxiliary rail 302, as shown in FIG. 5. The printing section draw-out handle 301 serves as mechanism configured to remove the printing unit 300*a* from the frame (main body) 100 of the multi-layer printing machine 2. Moreover, the each printing unit 300*a*, 300*b*, 300*c*, 300*d*, or 300*e* has the same configuration as the corresponding printing section 104*a*, 104*b*, 104*c*, 104*d*, or 104*e*, therefore the detailed explanation is omitted.

Further, the first printing unit 300*a* may be provided with a mechanism, which locks the first printing unit 300*a* so that the first printing unit 300*a* is not removed from the frame 100 of the multi-layer printing machine 2 during printing operation, and releases the lock in the case where the printing operation is completed or interrupted.

Therefore, in the first embodiment, the frame (main body) 100 of the multi-layer printing machine 1 or 2 may be equipped with five fixed printing sections 104*a*, 104*b*, 104*c*, 104*d*, 104*e* or five removable printing units 300*a*, 300*b*, 300*c*, 300*d*, 300*e*. However, the number of printing sections 104*a*, 104*b*, 104*c*, 104*d*, 104*e* or printing units 300*a*, 300*b*, 300*c*, 300*d*, 300*e* may be more or less than five.

Figure 6:
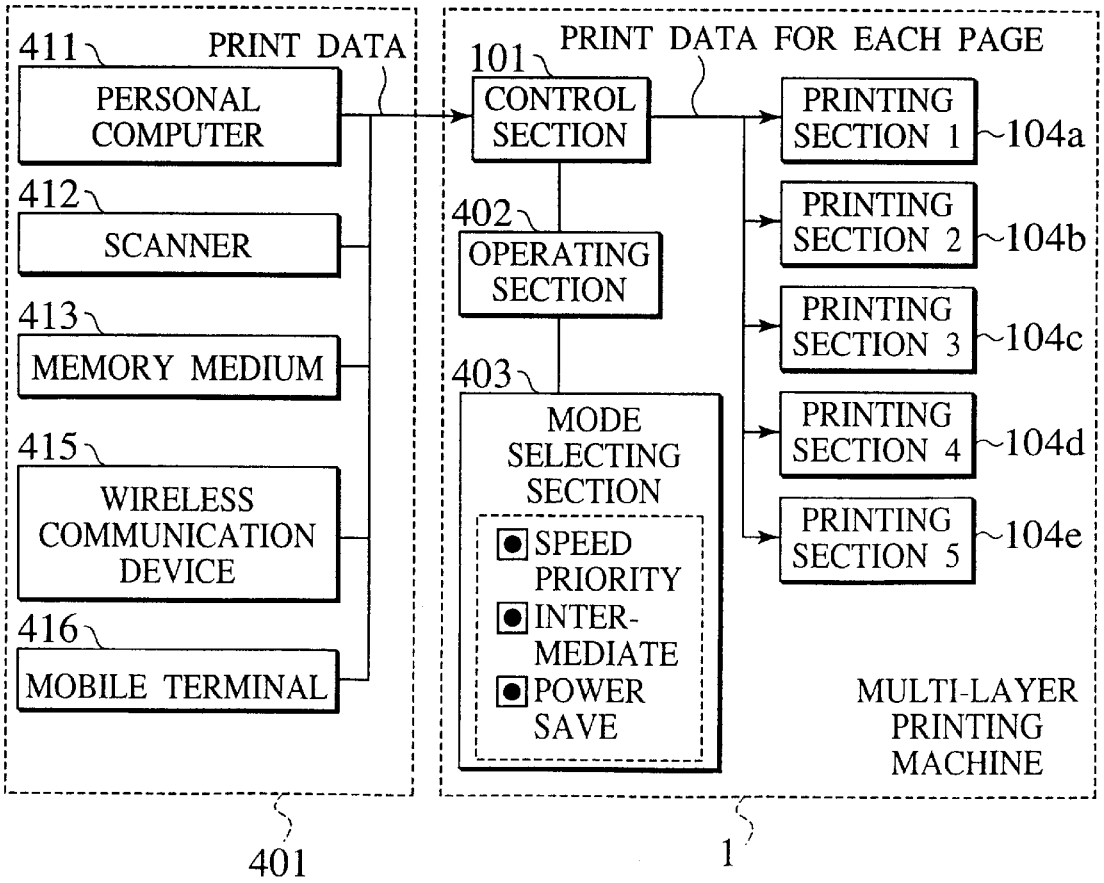
FIG. 6 is a view to explain a configuration of a control system of the multi-layer printing machine according to the first embodiment of the present invention.

The control section 101 is connected with a print request terminal 401, an operating section 402, and the first to fifth printing sections 104*a*–104*e* (or the first to fifth printing units 300*a*–300*e*) as shown in FIG. 6 in the first embodiment, and has a communication function. Further, the control section 101 performs: the processing of capturing a print request or many sheet of print data inputted from the outside device such as a personal computer; the processing of dividing the many sheet print data captured from the outside device into each page to transmit a print data for each page to each printing section; and the processing of controlling a delivery of print paper from paper feed to paper eject. Moreover, the above many sheet print data includes the number of many copies per page, one copy per many pages, and the number of many copies per many pages.

The print request terminal 401 are a personal computer 411, a scanner 412, a memory medium 413, a wireless communication device 415, a mobile terminal 416 (Personal Digital Assistants, digital camera or the like) which can be transmitted to the multi-layer printing machine, etc. about a printing demand or printing data.

The operating section 402 selects whether the operation relative to print control is automatically or manually made. The operating section 402 is connected with a mode selecting section 403, which allows the user to select printing modes, such as a power-save mode, a speed-priority mode, an intermediate mode. In this first embodiment, the mode selecting section 403 is shown as a button; however, the mode may be selected by transmitting a mode selection signal to the control section from the outside device such as the personal computer or the like.

The following is a description on an operation of the multi-layer printing machine having the above configuration.

First, the control section 101 receives print request and print data from the print request terminal 401.

Next, the control section 101 transmits a control signal to the paper feed section 102 and the first to fifth printing sections 104*a*–104*e* according to the received print request and print data. The paper feed section 102 feeds a print paper set in the paper feed tray 106 one by one according to the control signal, and then, supplies it to the fed paper delivery section 103. The fed paper delivery section 103 delivers the print paper fed from the paper feed section 102 to each of printing sections 104*a*–104*e*. In the first embodiment, the fed paper delivery section 103 has no control what to deliver the print paper to which of the plurality of printing sections 104*a*, 104*b*, 104*c*, 104*d*, 104*e*, and each of the printing section 104*a*, 104*b*, 104*c*, 104*d*, 104*e* is provided with a mechanism for taking in the print paper.

In other words, according to the control signal from the control section, each printing section 104*a*, 104*b*, 104*c*, 104*d*, 104*e* rotates the paper separating claw 201 around the rotary shaft 201*a*, and thereby, take the print paper fed from the paper feed section 103 therein. The taken-in print paper is guided to the first paper feed guide plate 202, and then, is taken in the paper feed roller 203. The paper feed roller 203 feed the print paper at a print speed according to the control signal from the control section 101, and the print paper is printed by the print head 204. The print paper thus printed is delivered by the eject roller 205, and then, is guided to the second paper feed guide plate 206, and thereafter, is fed to the ejected paper delivery section 105. The ejected paper delivery section 105 delivers the print paper fed from each printing section 104*a*, 104*b*, 104*c*, 104*d*, and 104*e* to the paper receiving tray 107. The print paper fed from the ejected paper delivery section 105 is successively piled up on the paper receiving tray in a state that the printed side is upwardly directed.

As described above, according to the first embodiment of the present invention, the multi-layer printing machine allocates print data for each page to each printing section so that a printing efficiency is improved. In addition, the printed sheet is not delivered to a plurality of paper receiving trays in a state of scattering, and is collected to one paper receiving tray; therefore, the user can smoothly receive the printed sheet.

Second Embodiment

This second embodiment of the present invention will describe a print control process in the case of printing a printed sheet having page order in the above multi-layer printing machine of the first embodiment. The basic configuration and operation are the same as the first embodiment. In the second embodiment, for simplification, five printing sections 104*a*–104*e* are used in the multi-layer printing machine, and one copy of a printed sheet having 15 pages is printed.

Figure 7:
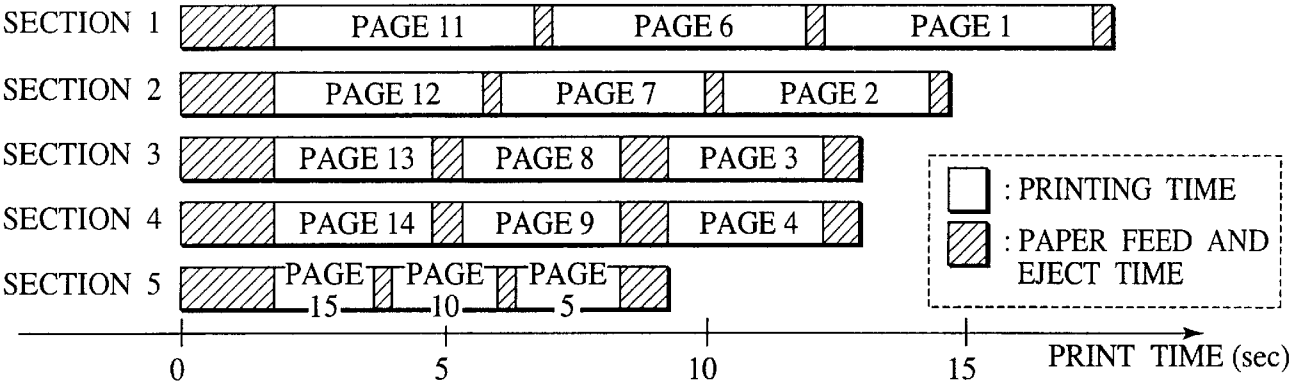
FIG. 7 is a timing chart showing the case where a printing process according to a second embodiment of the present invention is not carried out.

In the case of printing a printed sheet having the page order, as shown in FIG. 7, a page having long print time and a page having a short print time are allocated to each printing section, and printing is carried out. For this reason, the printing section printing many pages having a short print time complete earlier than the printing section the page having a long print time. As a result, a problem arises such that there is the difference in the page order of the printed sheet received in the paper receiving tray at the point time when the print is completed.

Figure 8:
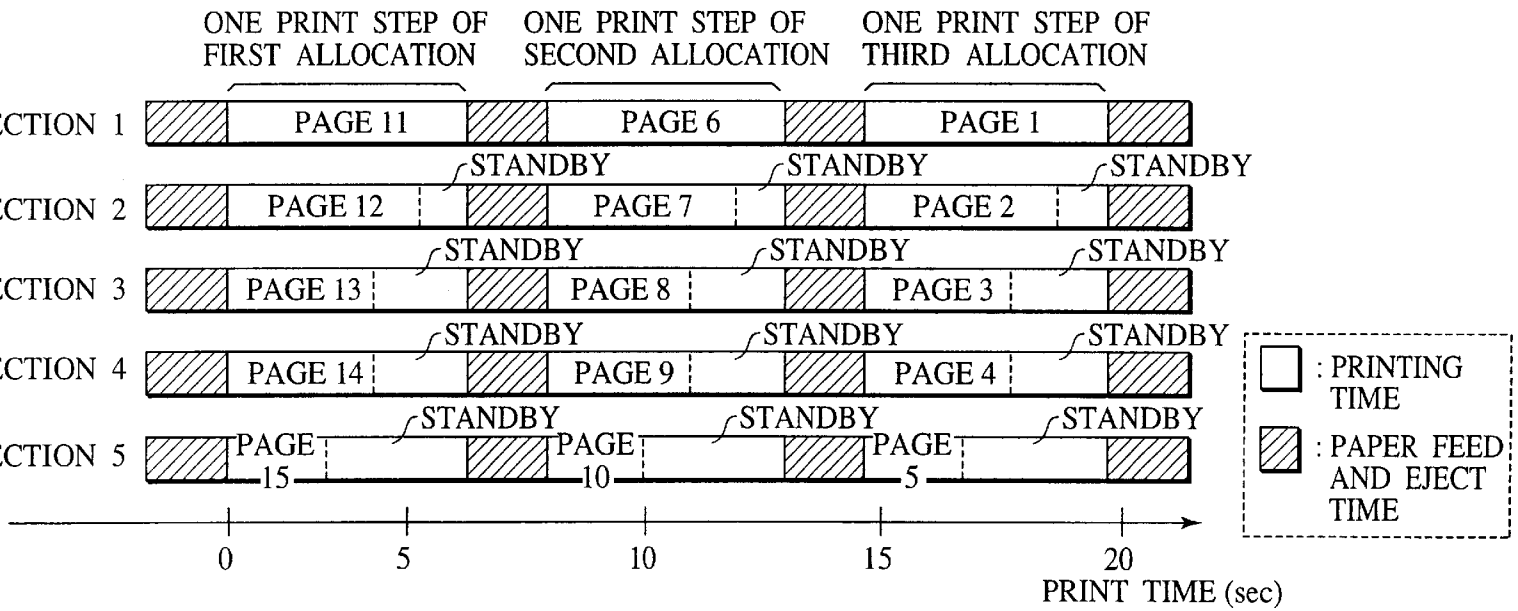
FIG. 8 is a timing chart showing the case where the printing process according to the second embodiment of the present invention is carried out.

As seen from FIG. 7, before the printing section 1 completes the print of page 11, the printing section 5 has already finished the print of pages 15 and 10. In order to solve the above problem, according to this second embodiment of the present invention, the following operation is carried out. According to the example of FIG. 7, the page having a long print time is page 11, page 6 and page 1, therefore, as shown in FIG. 8, all pages other than above are printed in a state that a standby time is added so as to synchronize with the print time of pages 11, 6 and 1.

The above standby time is added to any of printing process, and in this case, is added after print. As described above, the standby time is added after print, and thereby, is effectively spent as a time to dry ink.

Figure 9:
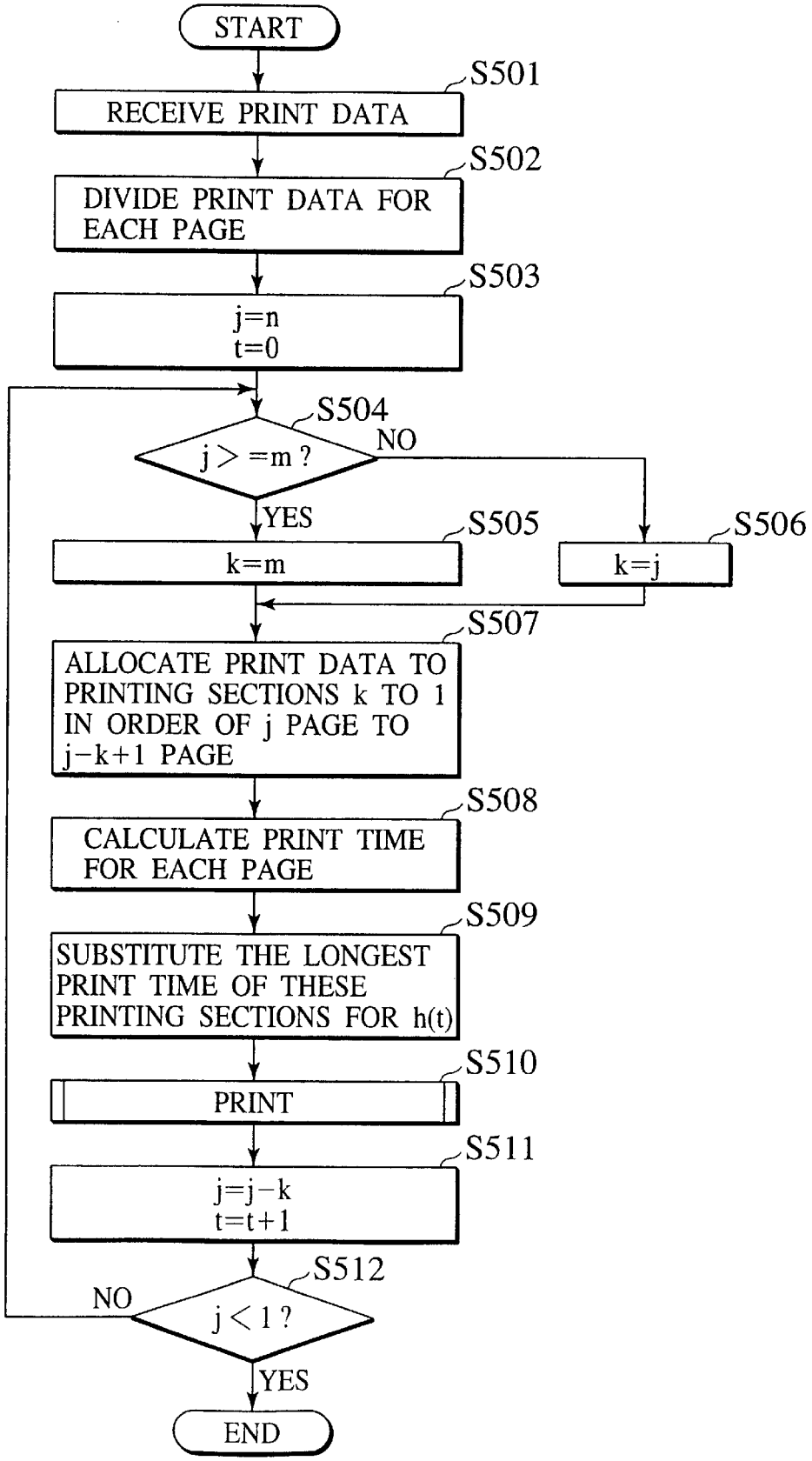
FIG. 9 is a main flowchart showing the printing process according to the second embodiment of the present invention.
Figure 10:
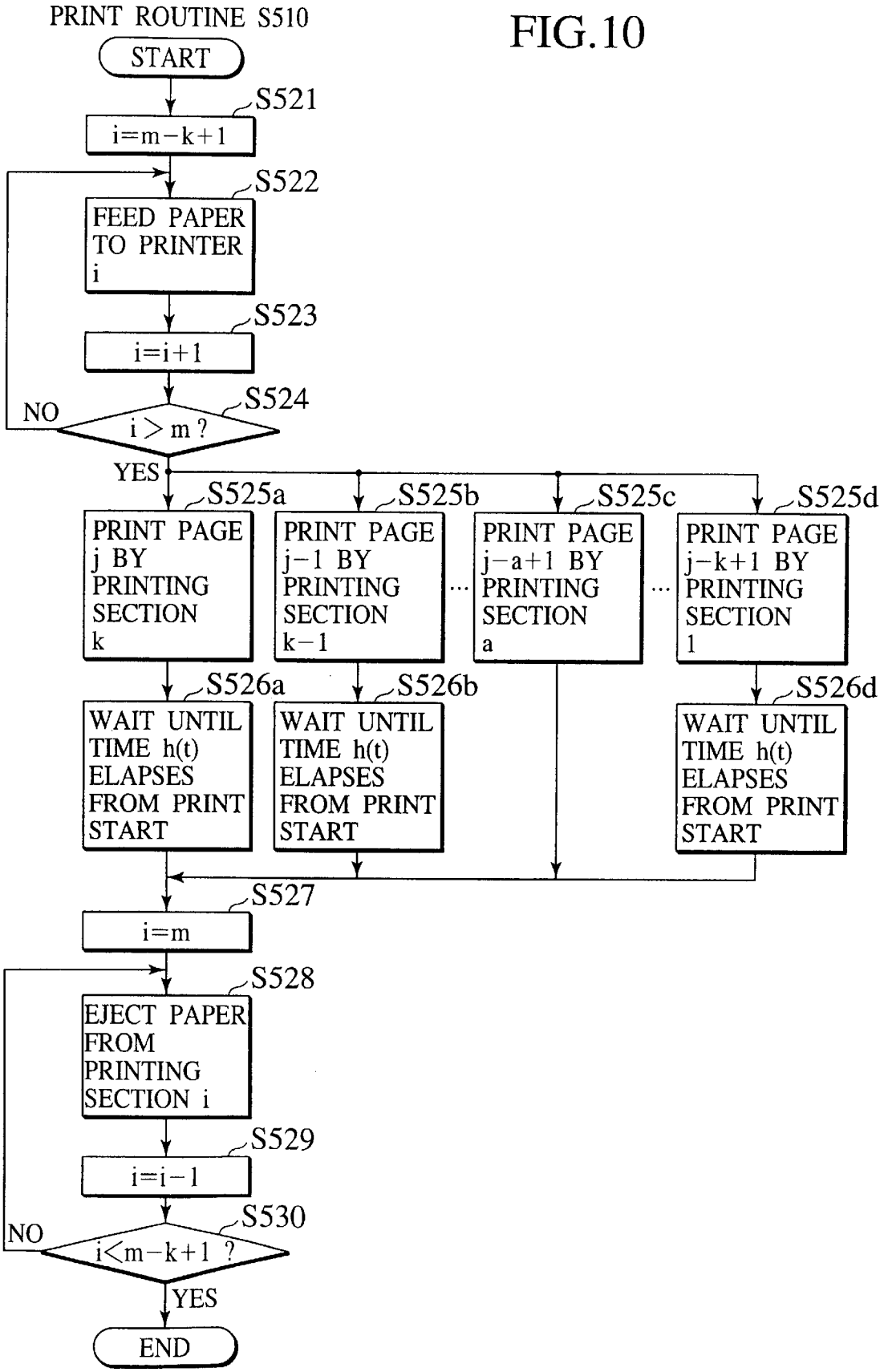
FIG. 10 is a print flowchart of the printing process according to the second embodiment of the present invention.

Next, a control method for printing at the above timing will be described below with reference to flowcharts of FIG. 9 and FIG. 10. FIG. 9 is a main flow of printing process, and FIG. 10 is a sub-routine of printing process.

In the second embodiment, a print time for each page is previously calculated from a print ratio of print data which is allocated for one print step, and then, based on the print time, a print time of other printing sections is adjusted so as to synchronize with the printing section having the longest print time.

Steps S501 to S503 are print preparation steps, and steps S504 to S512 are steps for allocating all pages of printed sheet to each printing section and printing them.

First, in step S501, the control section 101 receives print request and print data from the print request terminal 401 such as the personal computer or the like.

Next, in step S502, the control section 101 divides the received print data into data for each page, and in step S503, a page variable j indicative of the remaining number of printing sheets is set to the total number of print papers n (page number x number of copies), and a loop count variable t is set to the initial value 0.

Subsequently, in step S504, a constant m is set as the number of printing sections currently usable, and a variable k is set as the number of printing sections printing at this time. If the remaining number of printing sheets j is larger than the number of printing sections m, the number of printing sections m is substituted for the variable k (step S505). On the other hand, if the remaining number of printing sheets j is smaller than the number of printing sections m, the remaining number of printing sheets j is substituted for the variable k (step S506).

Subsequently, in step S507, as shown in FIG. 1, a page data is allocated to the upper-stage printing section from the lower-stage printing section in succession and from the final page in succession. This is because of holding a state that the print paper is sorted in the page order when being printed and received in the paper receiving tray.

Subsequently, in step S508, the control section 101 calculates a print time spent for each page, and in step S509, substitutes the longest print time of pages allocated to the printing sections for a variable h(t). In this case, the number of printing section having the longest print time is set as a.

Subsequently, in step S510, the print head prints the print paper.

Subsequently, in step S511, the control section subtracts the number of sheets k printed at this time from the page variable J, and adds "1" to the loop count.

Subsequently, in step S512, if there is a page, which is not still printed, the control sequence returns to step S504, printing is repeated. If printing is all completed, printing ends.

Next, the details of step S510 will be shown in the flowchart of FIG. 10.

Steps S521 to S524 show a flow for feeding a print paper to each printing section one by one from the fed paper delivery section 103 in succession from the upper-stage of printing sections usable in the multi-layer printing machine.

First, in step S521, a variable i is set a printing section number, and the number of printing sections k which perform printing is subtracted from the number of printing sections m, and further, a number to which "1" is added is substituted for the variable i. In this case, the printing section number is given from the upper-stage to the lower-stage of the printing sections included in the multi-layer printing machine frame in ascending order.

Next, in step S522, the paper feed section feeds a print paper to the printing section having the printing section number i inputted in step S521.

Subsequently, in step S523, "1" is added to the printing section number i, and in step S524, if the printing section number i is smaller than the number of printing sections m, the control sequence returns to step S522, and paper feed is repeated.

Subsequently, when a print paper is fed to all usable printing sections one by one by the flow from steps S521 to S524, each printing section simultaneously starts to print in steps S525*a*, S525*b*, S525*c* and S525*d*.

Subsequently, if the printing section having the longest print time of pages allocated to each printing section in step S509 is the printing section "a", the printing section "a" usually carries out printing (step S525*c*), and the printing sections (steps S526*a*, S525*b* and S526*d*) other than above are waiting until the time h(t) elapses from the print start.

Next, steps S527 to S530 show a flow for ejecting a print paper printed by each printing section to the ejected paper delivery section 105 one by one in succession from the lower-stage of printing sections usable in the multi-layer printing machine.

First, in step S527, the number of printing sections m is substituted for the printing section number i, and in step S528, the print paper printed by the printing section number i is ejected to the ejected paper delivery section.

Subsequently, in step S529, "1" is subtracted from the printing section number, and in step S530, the number subtracting the number of printing sections k is subtracted from the number of printing sections m. If the printing section number i is larger than a number to which "1" is added, the control sequence returns to step S528, and then, paper eject is repeated. On the other hand, if the printing section number i is smaller than the number to which "1" is added, the paper eject ends.

As described above, according to the control method of the second embodiment of the present invention, in the multi-layer printing machine, the time spent for printing is the same in all printing sections, therefore, paper eject timing is easy to be controlled. Further, in the case where the printed sheet having the page order is printed, at the point of time when printing is completed, the printed sheet received paper receiving tray is sorted along the page order, therefore, no collate work is required.

Further, in the case where the print paper is collectively fed and ejected, there is no need of driving the paper feed/eject mechanism during print; therefore, power saving can be achieved.

Third Embodiment

In the third embodiment of the present invention, the basic configuration and operation are the same as the above first embodiment. The third embodiment differs from the first embodiment in that print start timing is stepwise adjusted in each printing section. In other words, the print start timing is stepwise shifted in each printing section. The shift time is given below. Shift time=(total paper feed and eject time)/k. The total paper feed and eject time is a time spent for the paper feed and eject of all printers. Thus, the print paper is discharged to the ejected paper delivery section from only one printing section, and then, in the paper receiving tray, the print paper is continuously discharged one by one at equal intervals. Moreover, the total paper feed and eject time is different depending upon the number of printing sections and print paper size. In the third embodiment, for simplification, five printing sections are used in the multi-layer printing machine, and one copy of a printed sheet having 15 pages is printed.

Figure 12:
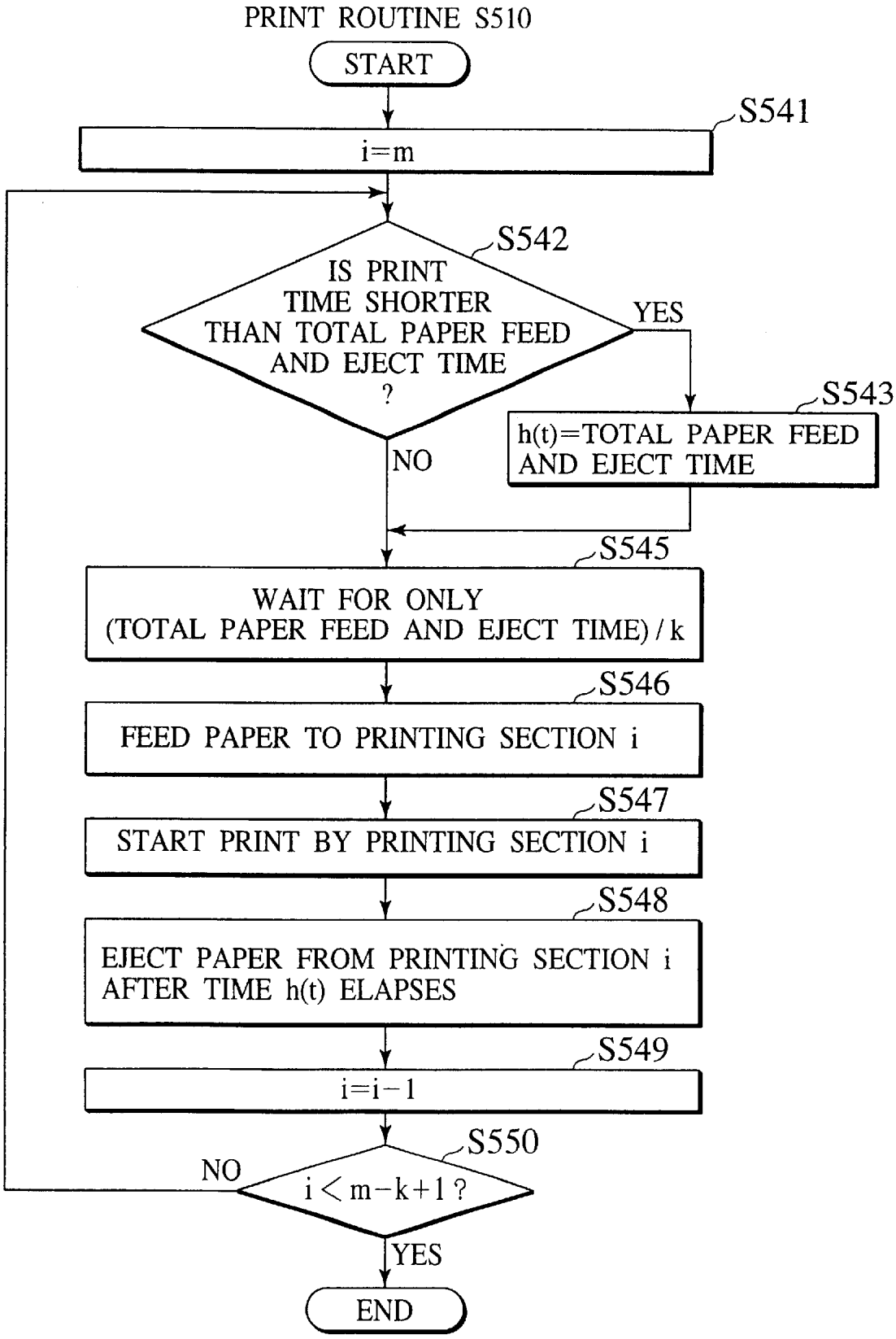
FIG. 12 is a print flowchart of the printing process according to the third embodiment of the present invention.

Hereinafter, a control method for carrying out the print at the above timing will be described with reference to the flowchart of FIG. 12. The main flow is the same as the second embodiment, therefore, the details are omitted, and only sub-routine of the print flow (S510) will be described below.

First, in step S541, a variable i indicative of printing section number is set to the number of printing sections m. In this case, the variable i indicative of printing section number is initialized to m.

Next, in step S542, if the print time is shorter than the total paper feed and eject time (step S542-YES), in step S543, the longest print time h(t) is set as the total paper feed and eject time. On the other hand, if the print time is longer than the total paper feed and eject time, the longest print time h(t) is unchanged (step S542-NO). In step S545, each printing section waits for only (total paper feed and eject time)/K so that paper feed and eject do not overlap in each printing section.

Figure 11:
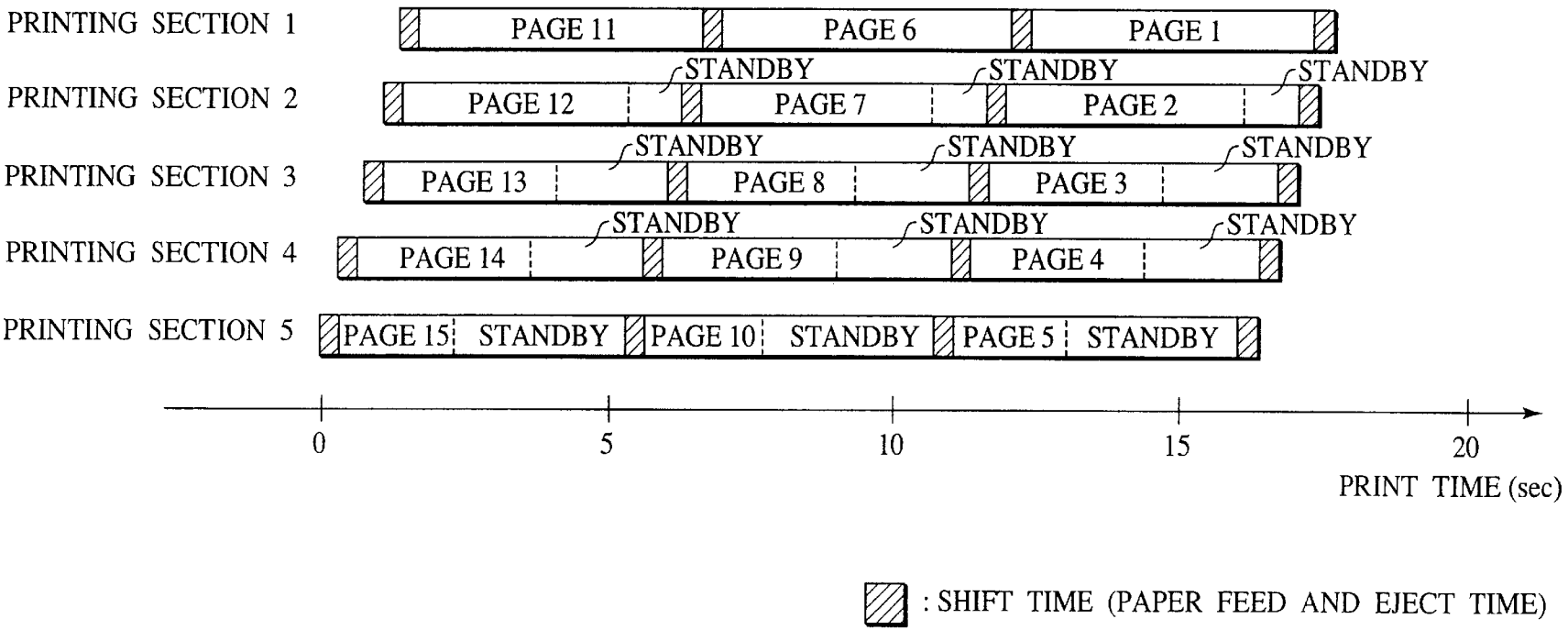
FIG. 11 is a timing chart showing a printing process of a third embodiment of the present invention (the case where a print start standby time is generated)

FIG. 11 shows a timing in which the third embodiment is applied to the same print data as the second embodiment, and the paper is fed and ejected one by one in succession.

Subsequently, in step S546, the paper feed section and the fed paper delivery section feeds the print paper to the printing section i, and in step S547, the printing section i starts to print the print paper.

Subsequently, in step S548, when the print head starts to print, print is carried out. When the longest print time h(t) elapses from the print start, the paper is ejected.

Subsequently, in step S549, "1" is subtracted from the variable i of print number so that a printing section which performs printing is set to a one-stage upper printing section.

Subsequently, in step S550, if the printing section i is less than a k-th printing section when upwardly counting the printing section from the lowest printing section in succession (when $i<m-k+1$), the control sequence returns to step S542. If the printing section i is more than a k-th printing section, the print ends.

As described above, according to the third embodiment of the present invention, in the multi-layer printing machine, when the paper is fed and ejected, it is delivered one by one; therefore, it is possible to readily carry out the control for feeding and ejecting the paper so that a plurality of papers is simultaneously supplied to the ejected paper delivery section.

Further, similar to the above second embodiment, in the case where the printed sheet having the page order is printed, at the point of time when printing is completed, the printed sheet received paper receiving tray is sorted along the page order; therefore, no collate work is required.

Fourth Embodiment

Figure 13:
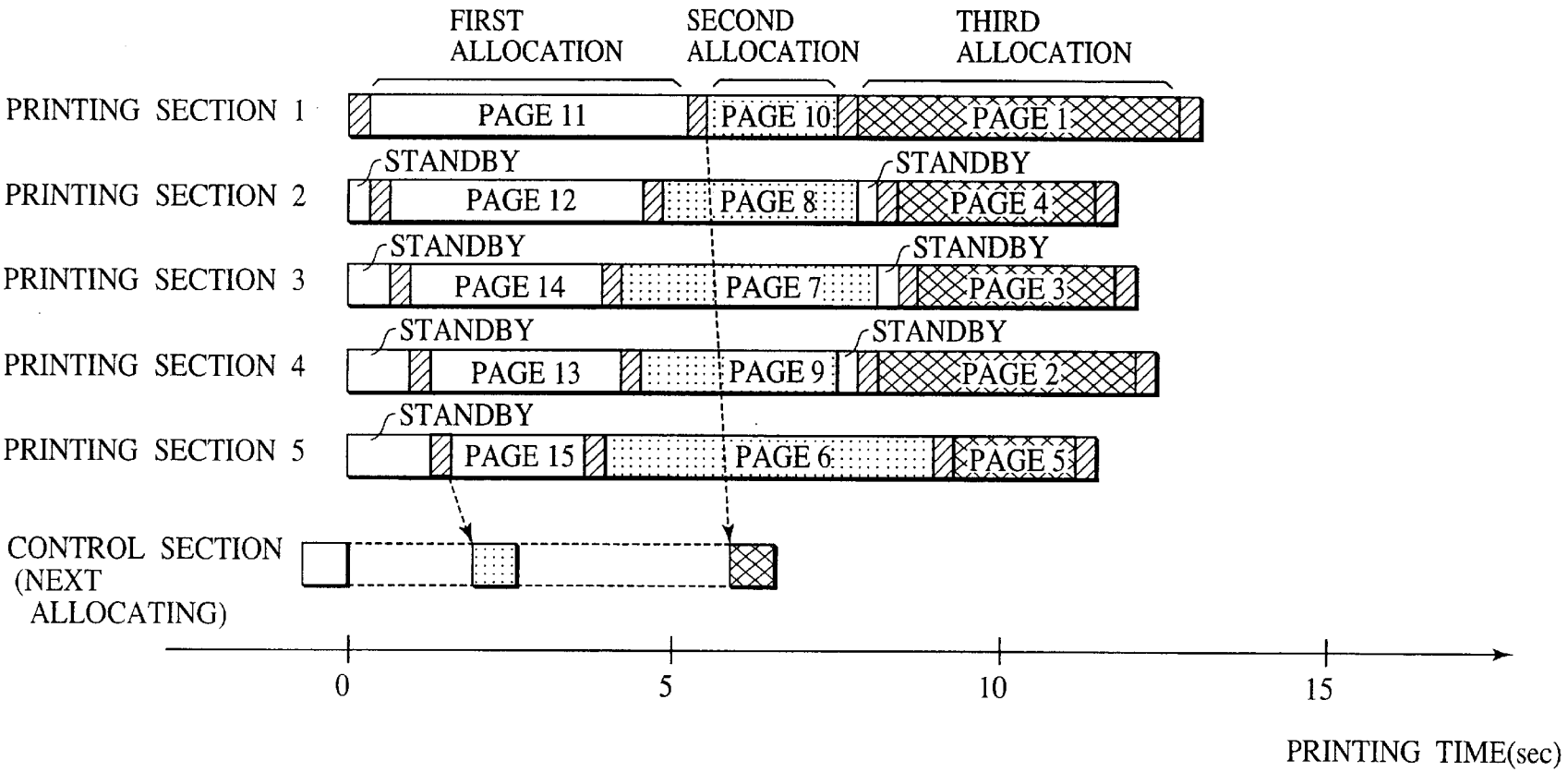
FIG. 13 is a timing chart showing a printing process according to a fourth embodiment of the present invention is carried out.

In the fourth embodiment of the present invention, the basic configuration and operation are the same as the above first embodiment. The fourth embodiment differs from the first embodiment in that time spent for print is previously calculated, and a print data for each page is allocated to each printing section so that efficiency is improved. In other words, the following adjustment is made, more specifically, a print job is allocated to a printing section on which print is earlier completed, in succession from a page having a long print time. In the fourth embodiment, five printing sections are used in the multi-layer printing machine, and FIG. 13 shows a timing chart in the case where one copy of a printed sheet having 15 pages is printed.

Figure 14:
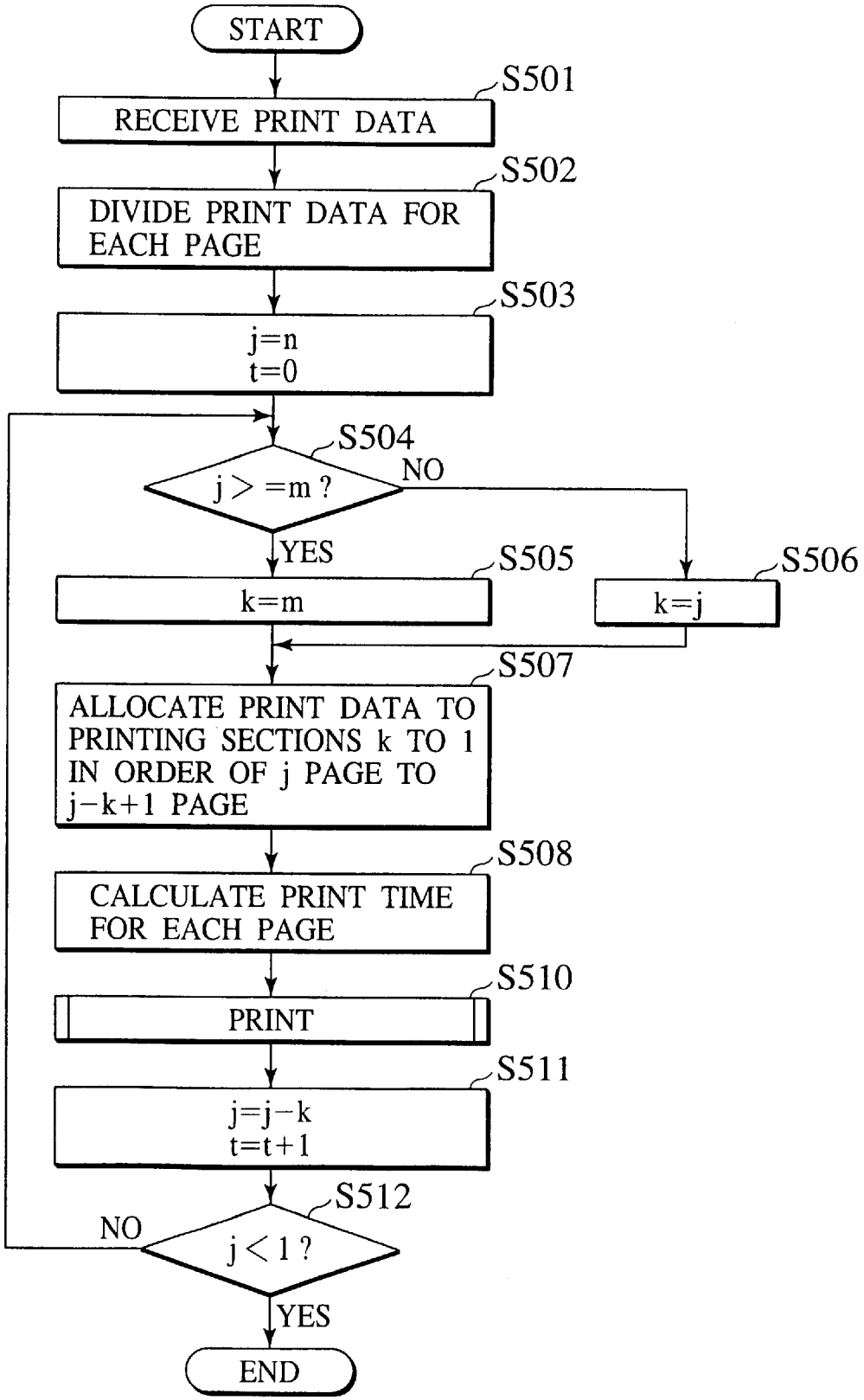
FIG. 14 is a main flowchart showing the printing process according to the fourth embodiment of the present invention.
Figure 15:
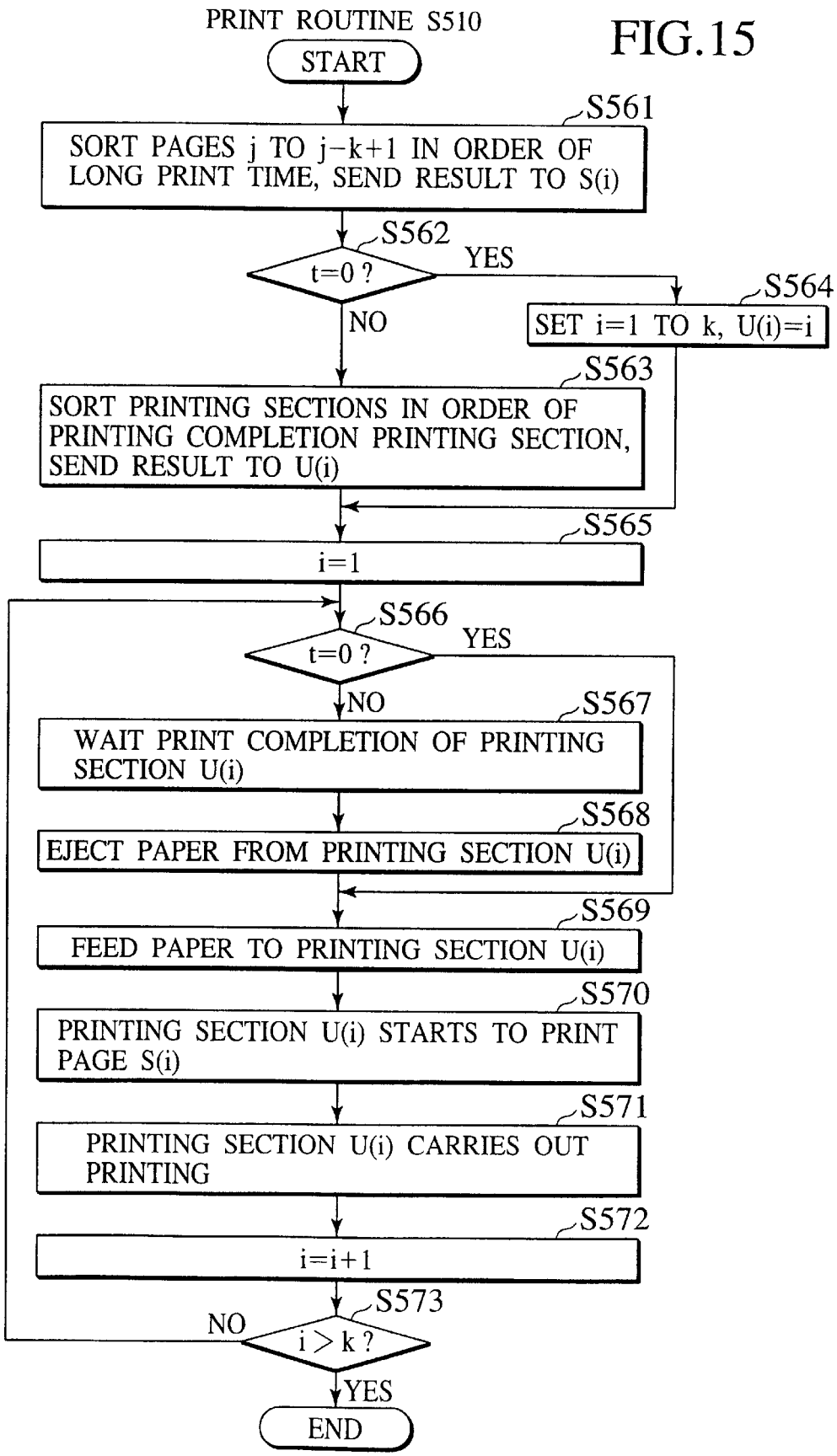
FIG. 15 is a print flowchart of the printing process according to the fourth embodiment of the present invention.

Hereinafter, a control method for carrying out printing at the above timing will be descried with reference to the flowcharts shown in FIG. 14 and FIG. 15.

The main flow (shown in FIG. 14) is the same as the second embodiment, however, the calculation of the longest print time in step S509 is not carried out.

First, in step S561, the control section sorts a page data allocated to each printer in the order of long print time, and then, substitutes the page number for S(i).

Next, in step S562, unless the print data is just received, the printing section number is substituted for U(i) in the order that currently printing print is earlier completed (step S563), on the other hand, if the print data is just received, U(i)=i (step S564).

Subsequently, in step S565, the control section substitutes the initial value 1 for a print number variable i so that a loop variable is initialized.

Subsequently, in step S566, unless the print data is just received, the printing section U(i) waits for print completion (step S567), and when the print is completed, the printing section ejects a paper (step S568). If the print data is just received, the control sequence proceeds to step S569.

Subsequently, in step S569, the paper feed section and the fed paper delivery section feed a paper to the printing section U(i).

Subsequently, in step S570, the print head of the printing section U(i) starts to print, and then, print processing is carried out (step S571).

Subsequently, in step S572, the control section 101 adds the initial value 1 to the loop variable i.

Subsequently, in step S573, if the data to be allocated to each printing section remains, the control sequence returns to step S566, on the other hand, unless the data to be allocated to each printing section remains, print ends.

As described above, according to the control method of the fourth embodiment of the present invention, in the multi-layer printing machine, the standby time spent for print time is considerably reduced, a print efficiency can be improved. Further, in particular, a great difference exists in time spent for print of each page, and thereby, a print efficiency can be improved.

Fifth Embodiment

The following is a description of the fifth embodiment of the present invention.

In the case of printing a printed sheet mixing a color page with a monochrome page and a printed sheet mixing a document page with an image page, a print time spent for one sheet is greatly different. For this reason, in the second embodiment or the like, the print time depends on a printed sheet having a longest print time.

Figure 16:
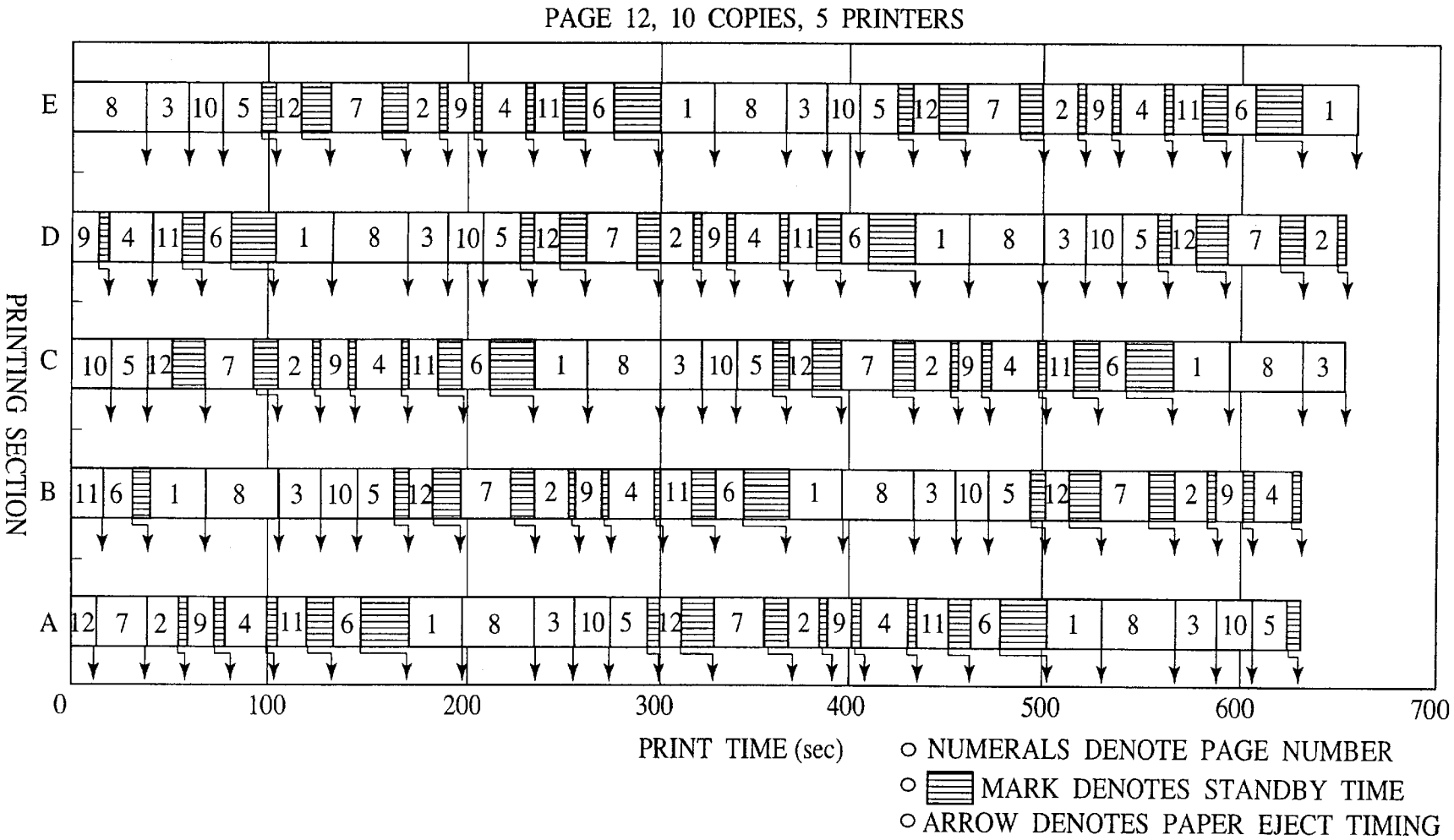
FIG. 16 is a timing chart showing a printing process according to a fifth embodiment of the present invention.

The following is a description on a print control processing by a starting serial print in succession from the printing section having print completion so as to reduce a standby time of printing section, and thereby, shortening time spent for print. FIG. 16 shows a timing chart in the case where five printing sections are used and printing is concurrently carried out when printing 10 copies of a 12-page printed sheet having different print time.

Figure 17:
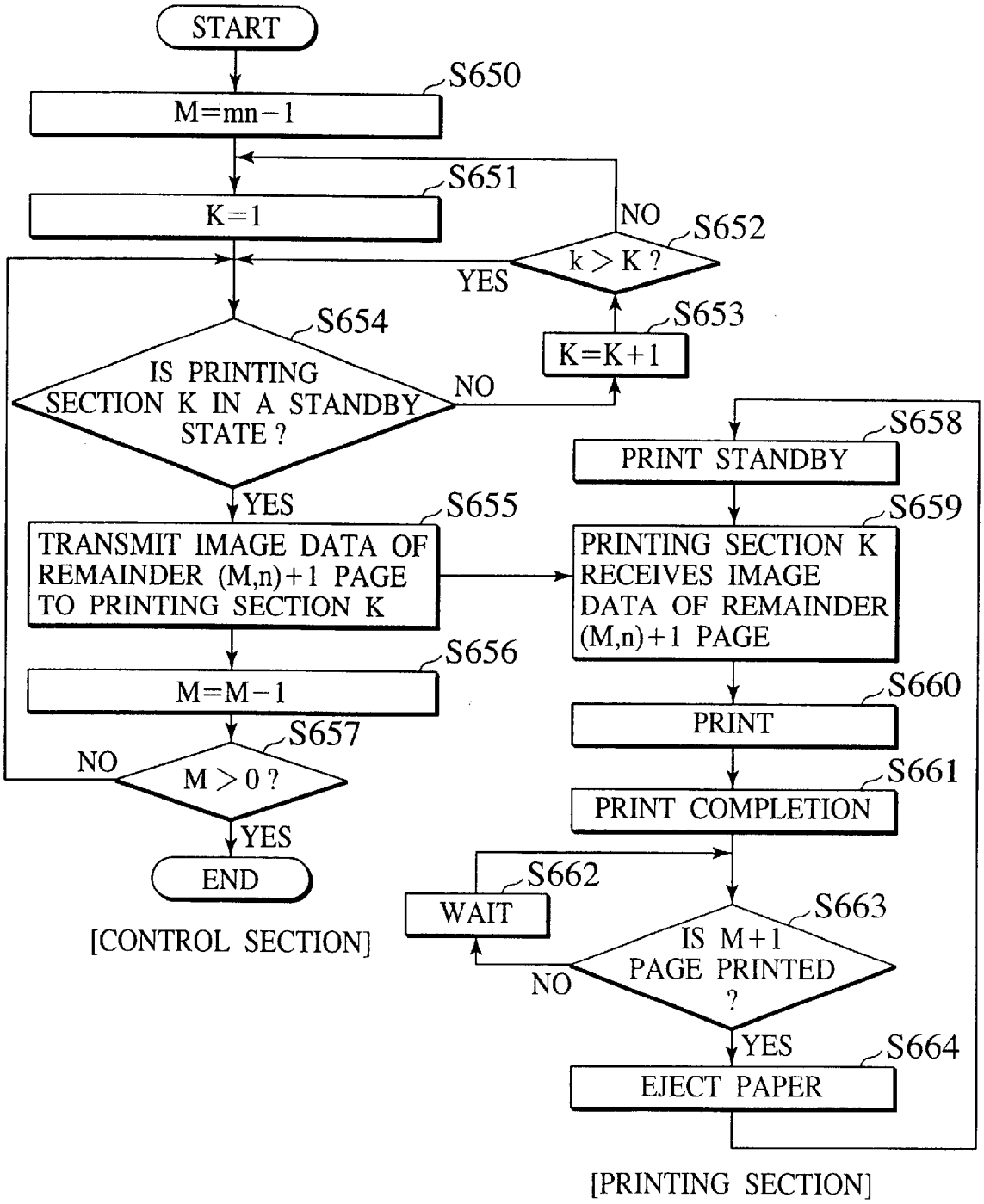
FIG. 17 is a flowchart showing the printing process according to the fifth embodiment of the present invention.

FIG. 17 is a flowchart showing a print flow. In the case where the number of print pages is set as m, the number of printing sections is set as n, and the total number of print sheets is set as mn, k printing sections are used, and printing is carried out.

First, a numerical value subtracting "1" from the total number of print sheets is set as a loop value M of the control section side (step S650).

Next, of the printing sections 1 to k, a printing section, which is in a standby state, is scan in succession from the printing section 1 (steps S651 to S654).

When confirming that a printing section K is in a standby state (step S654-YES), the control section sets a number in which "1" is added to the remainder dividing M by n, as P, and then, transmits a P-th page image data to the printing section K (step S655).

Subsequently, each printing section receives and prints the image data transmitted from the control section in step S655 (steps S660, S661).

Subsequently, in step S663, when print by each printing section is completed, if the print of the previous page is completed, the print paper is ejected (step S664), and then, each printing section is in a standby state until the next page print (step S658). Unless the print of the previous page is completed, each printing section waits until the print of the previous page is completed (step S655).

Then, the control section successively allocates the many-sheet print data to the printing section, which finishes print processing from above steps S658 to S664 (step S655).

Finally, in steps S656 and S657, the above operation is repeated with respect to the final page to first page.

As described above, according to the control method of the fifth embodiment of the present invention, in the multi-layer printing machine, a print data is allocated in succession to the printing section, which is in a standby state; therefore, there is no generation of useless time.

Sixth Embodiment

The following is a description on the sixth embodiment of the present invention.

Figure 18:
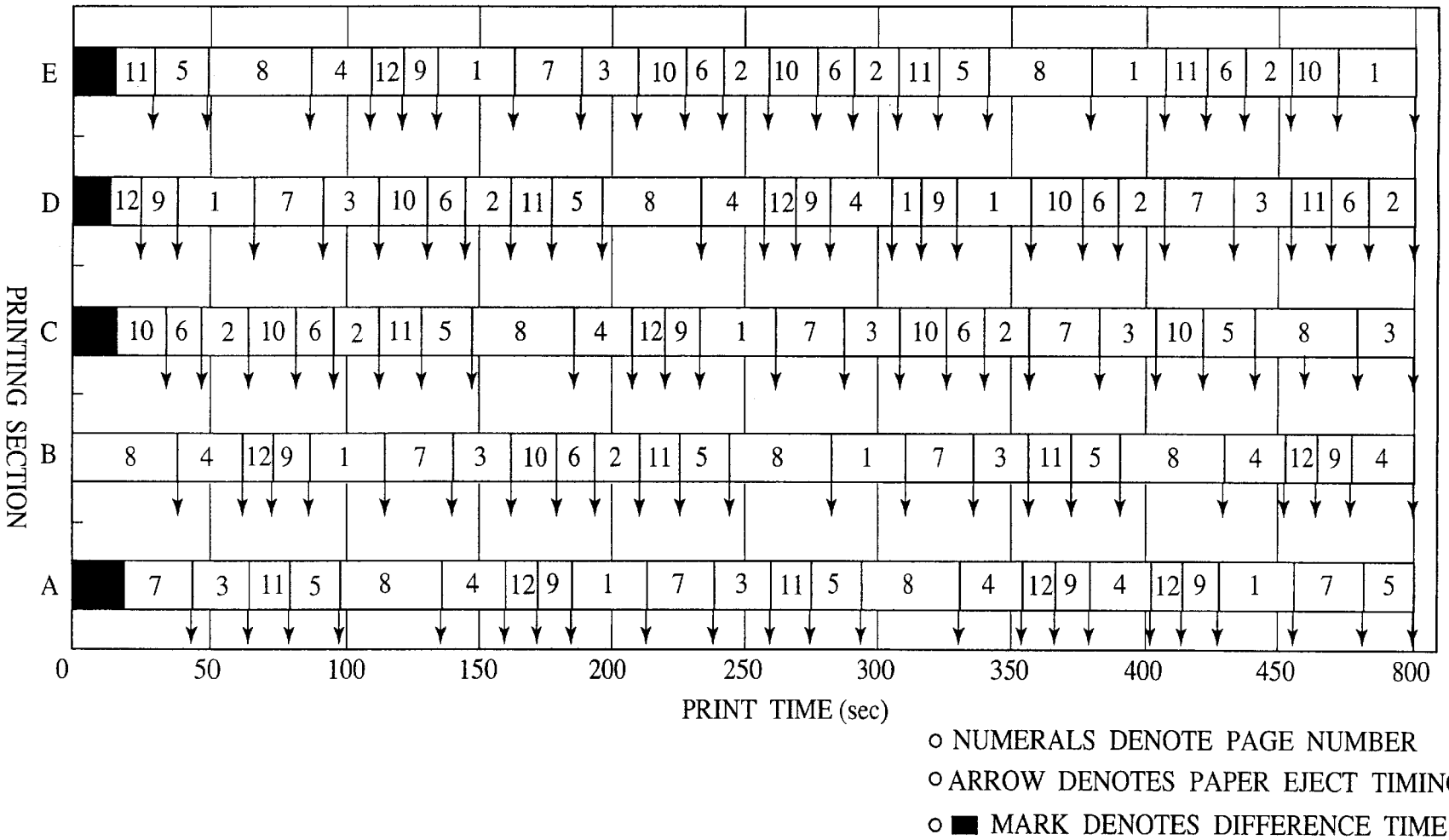
FIG. 18 is a timing chart showing a printing process according to a sixth embodiment of the present invention.

FIG. 18 is a timing chart in the case where when printing 10 copies of a 12-page printed sheet having different print time, five printing sections are used, and printing is concurrently carried out.

Figure 19:
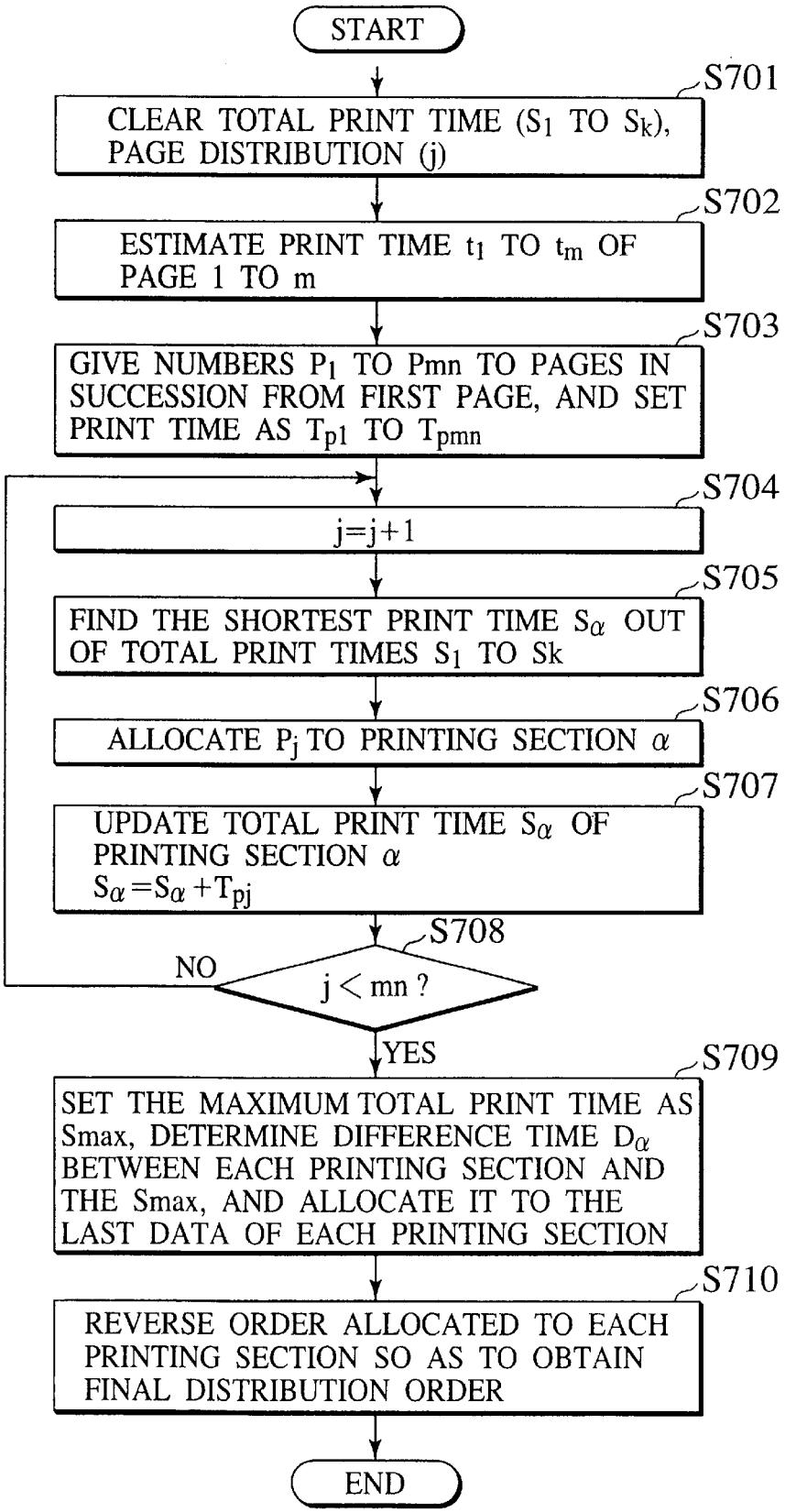
FIG. 19 is a flowchart showing the printing process according to the sixth embodiment of the present invention.

FIG. 19 is a flowchart showing a print flow. In the case where the number of print pages is set as m, the number of printing sections is set as n, and the total number of print sheets is set as mn, k printing sections are used, and printing is carried out. In this case, of k printers, a total print time of $\alpha$-th printer is set as $S_\alpha$.

First, in step S701, the total print time $S_1$ to $S_k$ and a variable j indicative of distribution order are set to the initial value "0".

Next, in step S702, the control section estimates print times $t_1$, to $t_m$ of print pages 1 to m from the print data. In this case, if n copies are printed, pages 1 to m are continuously printed n times; for this reason, the print pages have print times $t_1$, to $t_m$.

Subsequently, in step S703, n-times repeated and printed pages 1 to m are numbered as distribution order $P_1$ to $P_{mn}$ in the named order, and have print times $T_{p1}$, to $T_{pmn}$, respectively. In step S704, "1" is added to the distribution order j.

Subsequently, in step S705, the total print times ($S_1$ to $S_k$) of k printing sections are compared, and then, the shortest print time $S_\alpha$ is determined.

Subsequently, in step S706, a $P_\alpha$ print data is allocated to a α-th printer having $S_\alpha$. In this case, if S value is equal, the print data may be preferentially allocated to a printing section having small value α.

Subsequently, in step S707, the print time $T_{pj}$ of $P_j$ is added to $S_\alpha$ so that the total print time of the printing section α updated.

Subsequently, in step S708, using the total print times ($S_1$ to $S_k$) thus updated, the same operation (steps S704 to S707) is repeated until the allocation of all pages is completed.

Subsequently, in step S709, after the allocation of all pages is completed, the maximum total print time $S_{max}$ is determined. Further, the difference time $D_1$ to $D_k$ between the maximum total print time and the total print time of each printing section is calculated from the following equation, and then, the calculated difference time $D_\alpha$ is added to the last print data of each printing section.

$$D_\alpha = S_{max} - S\alpha$$

Finally, in step S710, the order allocated to each printing section is reversed so that $D_\alpha$ comes to the first data, and thus, the final distribution order is obtained.

As described above, according to the control method of the sixth embodiment of the present invention, in the multi-layer printing machine, although print start page and print start time are not made along the page order, print completion order and print completion time are made along the page order. Therefore, there is no generation of standby time, so that print distribution can be effectively carried out.

Seventh Embodiment

In the seventh embodiment of the present invention, the basic configuration and operation are the same as the above first embodiment. The seventh embodiment differs from the above first embodiment in controlling whether the user selects a print data allocation method, or the optimum print data allocation method is automatically selected.

Figure 20:
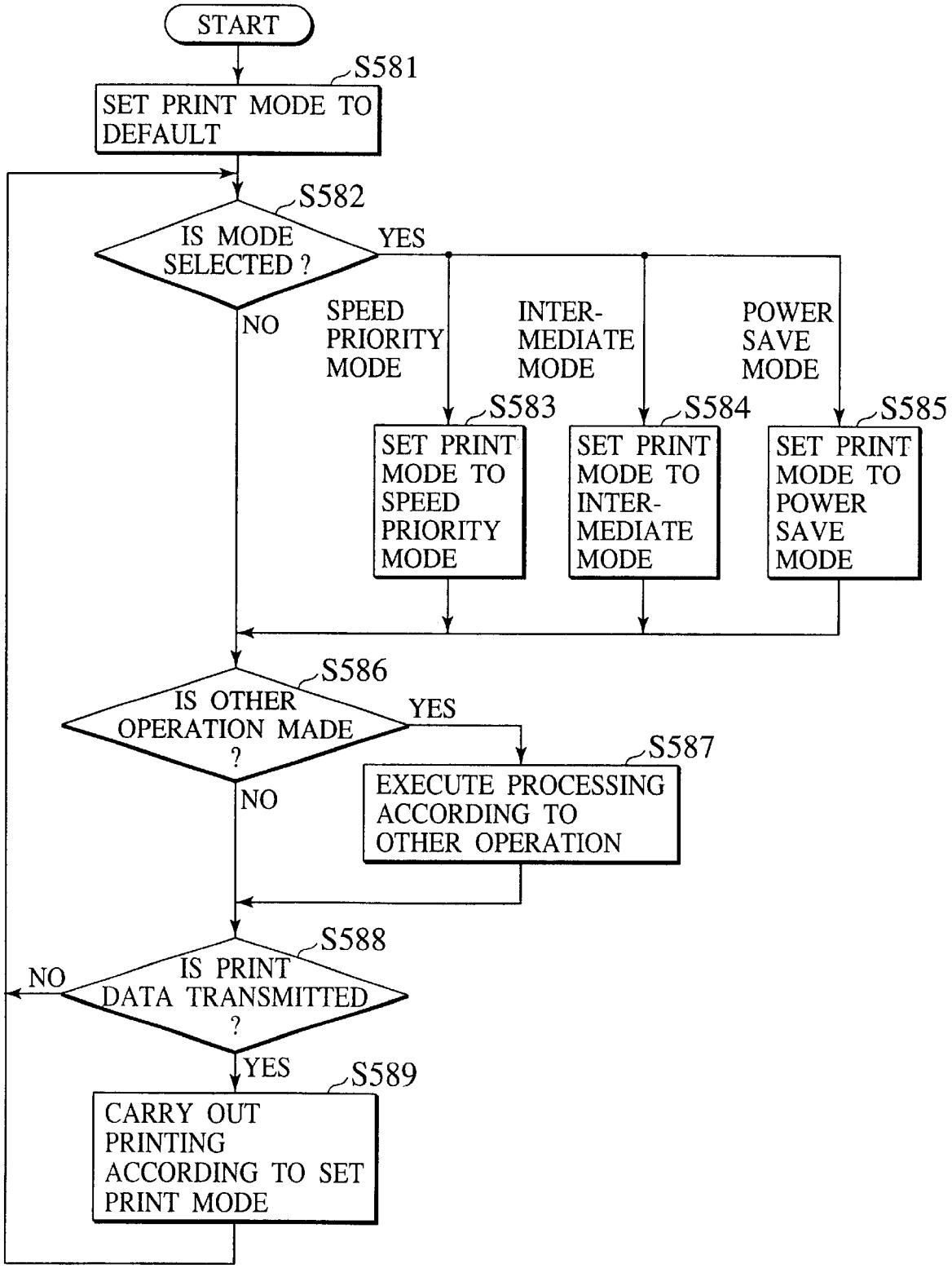
FIG. 20 is a flowchart showing a printing process according to a seventh embodiment of the present invention.

The above control method will be described below with reference to FIG. 6 and FIG. 20.

First, in step S581, a print mode of the mode selecting section 403 is set to default. In this case, the user previously determines which print mode is set to default, and it is stored in the multi-layer printing machine.

Next, in step S582, when the print mode is selected in the mode selecting section 403, the print mode is changed to the selected print mode. In this seventh embodiment, the print modes includes the printing speed priority mode (steps S583) which performs print processing of the fourth embodiment, the printing intermediate mode (step S584) of the third embodiment, and the printing power save mode (step S585) which performs print processing of the second embodiment.

Subsequently, in step S586, if the operating section 402 makes other operation, processing is carried out according to the operation (step S587).

Subsequently, in step S588, unless the print data is sent to the control section, the control sequence returns to step S582. If the print data is sent to the control section, printing is carried out according to the print mode set in step S582 (step S589). When the print is completion, the control sequence returns to step S582, the control section 101 waits for data input.

As described above, according to the control method of the seventh embodiment of the present invention, in the multi-layer printing machine, it is possible to select the optimum print data allocation method with respect to the printed sheet having remarkably different print data for each page such as a printed sheet mixing monochrome or color page, and to a printed sheet having almost no difference in the print data for each page.

Eighth Embodiment

In the eighth embodiment of the present invention, the basic configuration and operation are the same as the above first embodiment. The eighth embodiment differs from the above first embodiment in the procedure before the print main flow in the second to fourth embodiment when the printing units 300*a*, 300*b*, 300*c*, 300*d*, 300*e* are used in the multi-layer printing machine.

Figure 21:
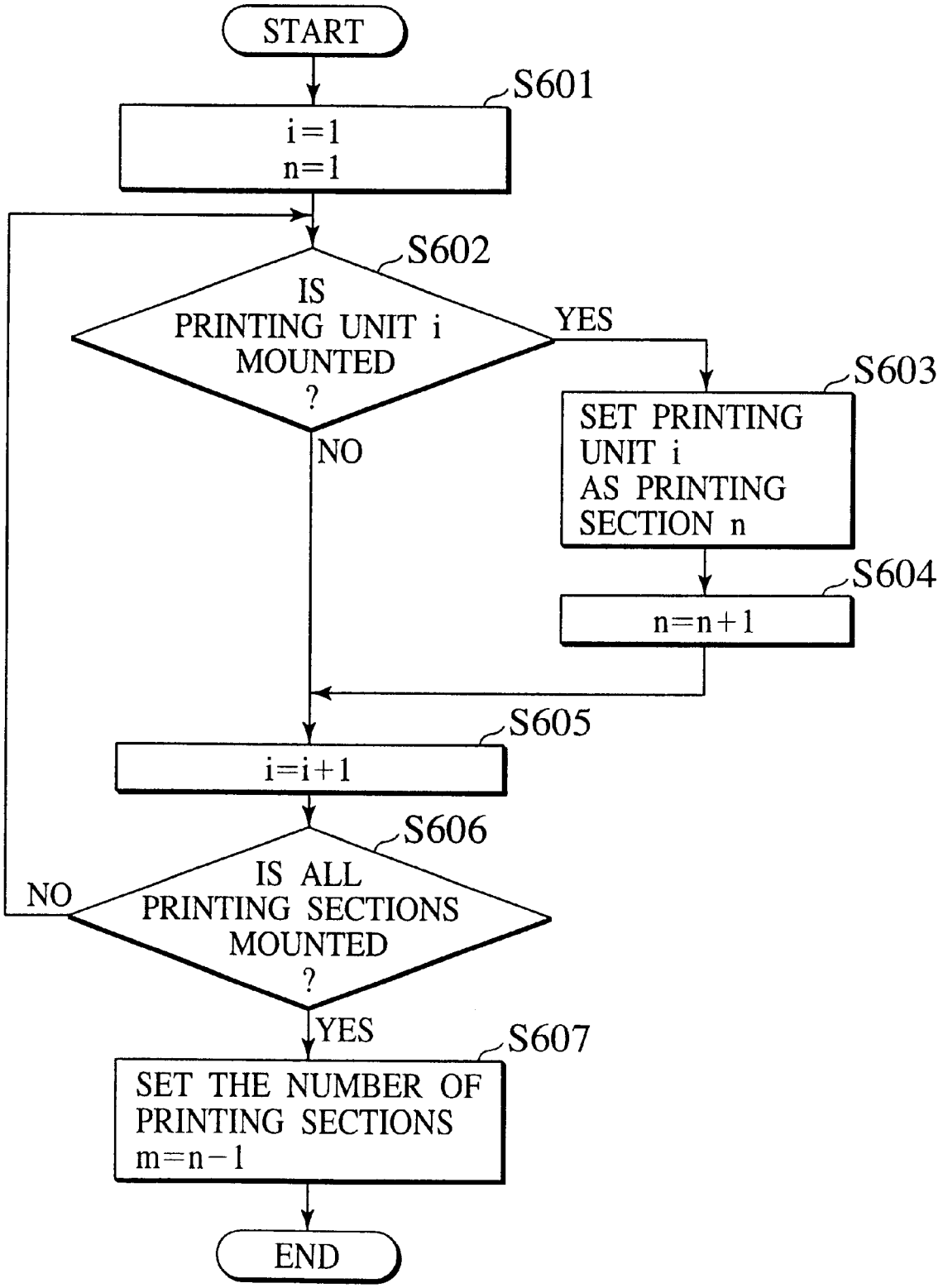
FIG. 21 is a flowchart showing a printing process according to an eighth embodiment of the present invention.

The above procedure will be described below with reference to FIG. 21.

First, in step S601, a variable i of the printing unit number and a variable n of the printing section number are both initialized, and then, are set to "1".

Next, in step S602, the control section makes a detection that the printing unit is mounted, and if the printing unit is mounted, in step S603, the printing unit i is set as the printing section n. Then, "1" is added to the variable i of the printing unit number (step S604), and the control sequence proceeds to step S605. On the other hand, unless the printing unit is mounted, in step S605, "1" is added to the variable i of the printing unit number.

Subsequently, in step S606, if there is a printing unit, which is not still mounted (step S606-NO), the control sequence returns to step S602, and if all of the printing units are mounted (step S606-YES), the control sequence proceeds to step S607.

Subsequently, in step S607, the number of printing units mounted into the multi-layer printing machine is substituted for a variable m indicative of the number of printing sections.

As described above, according to the control method of the eighth embodiment of the present invention, in the multi-layer printing machine, print is carried out without mounting the printing section into all stages of the frame of the multi-layer printing machine (at least one must be mounted).

Moreover, of the plurality of printing sections, even if the printing unit stops due to fault, trouble and ink replenishment, or even if the printing unit is removed, the print data is allocated to only stage into which the printing unit is mounted, and thereby, printing can be performed.

As described above, according to the control method of the eighth embodiment of the present invention, in the multi-layer printing machine including a plurality of printing sections, the paper receiving tray is collected to one; therefore, no collate work is required, and high-speed printing can be performed.

What is claimed is:

1. A printing machine comprising:

a frame;

a plurality of printing sections installed in the frame, each printing section having at least a print head that prints patterns on a print paper, and a mechanism to feed the print paper;

a print data input means configured to input a many-sheet print data of the patterns to be printed on the print paper;

a print data allocating means configured to allocate the many-sheet print data among each of the plurality of printing sections at a unit of a page;

a fed paper delivery means configured to feed the print paper to each of the plurality of printing sections; and an ejected paper delivery means configured to feed the print paper ejected from each of the plurality of printing sections to a common output location so that each sheet of the ejected print paper printed from the many-sheet print data arrives at said common output location in a desired sequence.

2. The printing machine according to claim 1, wherein the print data allocating means comprises:

a print time calculating means configured to calculate a time required for printing the patterns on each page of the many-sheet print data; and a print time control means configured to determine an allocation order of the many-sheet print data to each printing section and print timing on a result calculated by the print time calculating means.

3. The printing machine according to claim 2, further comprising:

a print start timing control means, which stepwise changes a print start timing of each printing section so that a print paper ejected from each printing section does not overlap in the ejected paper delivery means.

4. The printing machine according to claim 2, wherein the print time control means comprises:

an order changed storage means configured to change the order of the many-sheet print data in order of the long print time, and to store the changed order result; and an order determining means configured to refer the changed order result, and to allocate the many-sheet print data to each printing section.

5. The printing machine according to claim 1, wherein the print data allocating means comprises:

a paper eject timing control means, controlling a timing of ejecting paper from the printing section to the ejected paper delivery means so that the page order of print paper ejected from the plurality of printing sections is not disturbed.

6. The printing machine according to claim 1, wherein the print data allocating means sequentially allocates the many-sheet print data in order from a printing completion printing section.

7. The printing machine according to claim 2, wherein the print time control means allocates the many-sheet print data to each printing section based on a print completion time so that a print completion order becomes a desired order.

8. The printing machine according to claim 1, further comprising:

a print mode selecting means configured to select one of prescribed printing modes.

9. The printing machine according to claim 1, wherein each printing section is configured to be freely removable from the frame of the printing machine, the print data allocating means being adapted to recognize which ones of said plurality of printing sections are not removed and to allocate the many-sheet print data among each of the not removed printing sections.

10. The printing machine as claimed in claim 9, wherein at least one of said plurality of removable printing sections further comprises a lock that locks said at least one printing section into said frame during execution of a printing operation, and unlocks said at least one printing section so as to permit removal thereof from said frame when the printing operation is completed or interrupted.

11. A control method for a printing machine comprising a plurality of printing sections, each printing section having at least a print head that can print patterns on a print paper based on an inputted print data, and a mechanism configured to feed the print paper, comprising:

inputting a many-sheet print data of the patterns to be printed on the print paper; and allocating the many-sheet print data among each of the plurality of printing sections at a unit of a page; and feeding the print paper ejected from each of the plurality of printing sections to a common output location so that each sheet of the ejected print paper printed from the many-sheet print data arrives at said common output location in a desired sequence.

12. The control method for a printing machine according to claim 11, further comprising:

calculating a time spent for printing patterns on each page of the many-sheet print data; and determining an allocation order of the many-sheet print data to each printing section and print timing based on a calculated result.

13. The control method for a printing machine according to claim 12, wherein a print start timing of each printing section is stepwise changed so that a print paper ejected from each printing section does not overlap in the ejected paper delivery means.

14. The control method for a printing machine according to claim 12, further comprising:

changing the order of the many-sheet print data in order of the long print time, and storing the changed order result; and referring the changed order result, and allocating the many-sheet print data to each printing section.

15. The control method for a printing machine according to claim 12, wherein the many-sheet print data is allocated to each printing section based on a print completion time so that a print completion order becomes a desired order.

16. The control method for a printing machine according to claim 11, wherein a timing of ejecting paper from the printing section to the ejected paper delivery means is controlled so that the page order of print paper ejected from the plurality of printing sections is not disturbed.

17. The control method for a printing machine according to claim 11, wherein a print data is sequentially allocated in order from a printing completion printing section.

* * * * *